US007140470B2

(12) United States Patent
Azpitarte

(10) Patent No.: US 7,140,470 B2
(45) Date of Patent: Nov. 28, 2006

(54) SAFETY SYSTEM FOR MONITORING THE STATE OF ELEVATOR LANDING DOORS

(76) Inventor: Jean-Patrick Azpitarte, 27, rue de la Pépinière, 78150 Le Chesnay (FR)

( * ) Notice: Subject to any disclaimer, the term of this patent is extended or adjusted under 35 U.S.C. 154(b) by 182 days.

(21) Appl. No.: 10/620,649

(22) Filed: Jul. 16, 2003

(65) Prior Publication Data

US 2004/0231928 A1 Nov. 25, 2004

(30) Foreign Application Priority Data

Jul. 16, 2002 (FR) ..... 02 08983

(51) Int. Cl.
*B66B 13/26* (2006.01)

(52) U.S. Cl. ..... 187/317; 187/393

(58) Field of Classification Search ..... 187/247, 187/249, 316, 317, 313, 391–396, 248
See application file for complete search history.

(56) References Cited

U.S. PATENT DOCUMENTS

| | | | | |
|---|---|---|---|---|
| 3,461,422 | A * | 8/1969 | Hansen | 187/390 |
| 4,491,198 | A * | 1/1985 | Noda et al. | 187/391 |
| 4,750,591 | A * | 6/1988 | Coste et al. | 187/391 |
| 4,930,604 | A * | 6/1990 | Schienda et al. | 187/393 |
| 5,014,825 | A | 5/1991 | Suzuki | |
| 5,162,711 | A | 11/1992 | Heckler | |
| 5,443,142 | A * | 8/1995 | Glaser | 187/316 |
| 5,476,157 | A | 12/1995 | Todaro | |
| 5,780,787 | A * | 7/1998 | Kamani et al. | 187/316 |
| 5,955,710 | A * | 9/1999 | DiFranza | 187/396 |
| 6,193,019 | B1 * | 2/2001 | Sirigu et al. | 187/391 |
| 6,330,936 | B1 * | 12/2001 | Lence Barreiro et al. | 187/393 |
| 6,467,585 | B1 * | 10/2002 | Gozzo et al. | 187/391 |
| 6,543,583 | B1 * | 4/2003 | Lence Barreiro et al. | 187/391 |
| 6,603,398 | B1 * | 8/2003 | Tinone et al. | 340/541 |

FOREIGN PATENT DOCUMENTS

| | | |
|---|---|---|
| EP | 0 298 784 | 1/1989 |

* cited by examiner

*Primary Examiner*—Jonathan Salata
(74) *Attorney, Agent, or Firm*—Fish & Richardson P.C.

(57) ABSTRACT

To render the elevator landing doors fitted with an elevator control unit (5) safe, this system comprises: elevator landing door surveillance units (10), installed on each elevator landing door, to receive the state of the electrical contacts (11, 12) fitted to each of the elevator landing doors (21); synthesis unit (4) connected to the surveillance units (10) to receive the state of the elevator landing door electrical contacts (11, 12), and to the elevator control unit (5) to receive other information on the working order of the elevator; and alarm signal devices (13, 14); synthesis unit (4) further including means of determining (41) the state elevator landing doors are in according to the received information, and to actuate the signal devices (13, 14) if the state of the elevator landing doors is considered to be critical to the elevator users.

12 Claims, 2 Drawing Sheets

SAFETY SYSTEM FOR MONITORING THE STATE OF ELEVATOR LANDING DOORS

This invention relates to a safety system for the actuating of elevator landing doors, whether they are automatic swing or sliding doors.

One of the major risks that someone runs who uses elevators is that of falling down the elevator shaft due to the opening by mistake of an elevator landing door when the car has stopped at a different landing.

To avoid this risk, we have planned on installing, at each elevator landing door of the elevator shaft, a mechanical safety device comprising a mechanical locking system of the elevator landing door, and two electrical safety devices comprising a locking contact for the elevator landing door and a by-pass jumper for the elevator landing door. The mechanical safety device prevents the elevator landing door, (either swing or sliding), to be opened as long as the car is not in line with the door in question. The electrical safety devices prevent the elevator from moving as long as an elevator landing door is either open or unlocked.

There already exists a manual means of unlocking an elevator landing door from the landing, normally by using a specific triangular key. This means is usually reserved for use by technicians who have come to repair or maintain an elevator. However, unauthorised people in possession of a key could leave an elevator landing door unlocked, or open in the case of an automatic sliding elevator landing door.

Moreover, although instructions are given to maintenance technicians to physically check that the elevator landing doors are properly locked following maintenance work, an elevator landing door may be left unlocked.

In addition, on sites where there is deficient maintenance, the electrical safety devices may not be operational. Thus, an elevator may work with an unlocked elevator landing door.

When a swing elevator landing door is unlocked by error, someone may pull on it and fall down the elevator shaft if the car is not in line, or be crushed between the car and the landing.

This danger also exists when the elevator is fitted with automatic sliding elevator landing doors that can be unlocked and jammed open. There is also a risk of falling down the elevator shaft or being crushed between the car and the landing if the electrical safety devices are faulty.

The purpose of this invention is to eliminate these inconveniences by alerting the users and those responsible for the building management and elevator maintenance when an elevator landing door is unlocked or open. This objective is reached through the providing of an elevator landing door safety system fitted with an elevator control unit, and at each elevator landing door, electrical contacts that indicate the locking state and the closing state of the elevator landing door.

According to the invention, this system comprises:

elevator landing door surveillance units, installed on each elevator landing door, to receive the state of the electrical contacts fitted to each of the elevator landing doors, synthesis unit connected to the surveillance units to receive the state of the elevator landing door electrical contacts, and to the elevator control unit to receive other information on the working order of the elevator, alarm signal devices, synthesis unit further comprising means of determining the state in which the elevator landing doors are in according to the received information, and to actuate the signal devices if the state of the elevator landing doors is considered to be critical to the elevator users.

According to a special feature of the invention, this system comprises means of determining if the car is in the elevator landing door unlocking zone and means of determining if the car door is closed or not, the state of the elevator landing doors also being determined according to whether the car is or is not in the elevator landing door unlocking zone and the open or closed state of the car door.

According to another special feature of the invention, this system further comprises means of determining the position of the elevator car in the elevator shaft, these means being connected to the synthesis unit, the state of the elevator landing doors also being determined according to the position, provided by the means of determining the position of the car.

Advantageously, the means of determining the position of the car in the elevator shaft comprises a GPS receiver installed on the car or a device that measures the distance between a fixed point and the car.

Alternatively, the means of determining the position of the car in the elevator shaft comprises means of deducting this information from data provided by the elevator control unit, and from configuration and operating parameters of the elevator.

According to another special feature of the invention, this system comprises means of attributing a critical state, to the elevator landing doors if the car has stopped at a landing in line with an elevator landing door, and if another elevator landing door has been detected as being unlocked, or if the car has been detected between two landings and at least one elevator landing door has been detected as being unlocked.

Preferably, the alarm signal devices comprise means of sound and/or light signalling installed in the elevator shaft.

Likewise, preferably, the alarm signal devices comprise means of alarm signalling installed in the caretaker's premises.

Advantageously, the synthesis unit is linked to means of transmitting the state of the elevator landing doors to a remote maintenance system.

The means of transmitting preferably comprises a telephone transmitter. These means of transmitting can advantageously comprise a PSTN type telephone transmitter backed up by a GSM type transmitter.

A preferable embodiment of the invention will be described later, given as a non-restrictive example, with reference to the annexed drawings in which:

FIG. 1 diagrammatically represents an elevator;

Figure 1:
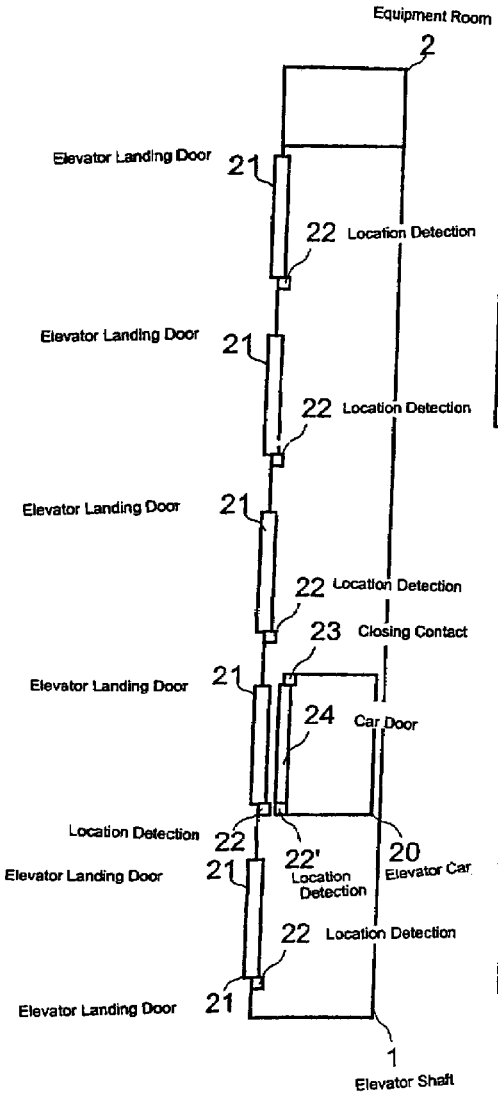

In FIG. 1, an elevator comprises an elevator shaft 1 in which a car 20 travels, an equipment room 2 which houses the elevator machinery, and the elevator landing doors 21 at each landing of the building that has an elevator. In addition, to determine if the car 20 is in line with an elevator landing door 21, the elevator comprises means of location detection 22, 22' of the car in the elevator landing door unlocked zone. The car is fitted with a car door 24 and a closing contact 23 of the car door.

Figure 2:
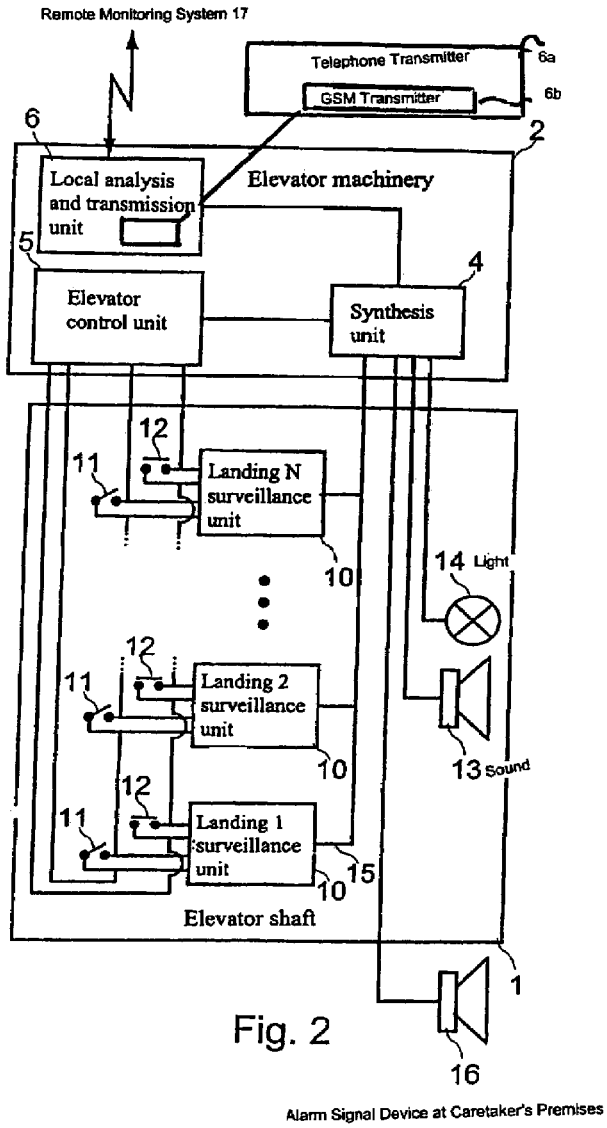
FIG. 2 represents, in a diagrammatical manner, an overall diagram of a safety system according to the invention.

Such as represented in FIG. 2, an elevator control system normally comprises an elevator control unit 5, installed in the equipment room, this control unit being connected to the elevator landing door locking contacts 11 and the elevator landing door by-pass jumpers 12, installed on each elevator landing door 21.

Each elevator landing door locking contact 11 is arrange so as to open when the elevator landing door 21 is unlocked either by the car door when the latter is fully open, or by the manual unlocking system (via the triangular key). The by-pass jumper 12 only closes when the elevator landing door is closed, but not necessarily locked.

All the locking contacts 11, on one hand, and all the by-pass jumpers 12, on the other hand, are series-connected, so that the control unit 5 only has the following information "at least one elevator landing door unlocked" and "at least one by-pass jumper open".

The control unit 5 also has opening information for the elevator door 24 of the car 20, provided by the electrical contact 23 for the closing of the car, and information on whether the car is or is not in the elevator landing door 21 unlocking zone, provided by the means of detection 22, 22'. The closing contact 23 of the car door is closed at the end of the closing travel of the door and open at the beginning of the opening travel of the door.

When the elevator car 20 enters an unlocked zone, in line with an elevator landing door 21, the car door 24 opens, which consequently opens the car door contact 23. The car's arrival mechanically actuates the unlocking of the elevator landing door 21 and thus the opening of the elevator landing door locking contact 11. If someone enters or exists the car, the by-pass jumper 12 opens when the elevator landing door opens. When the elevator landing door closes the elevator landing door by-pass jumper 12 closes. At the start of the closing of the car door, the elevator landing door is locked, which results in the locking contact 11 being closed. At the end of the closing travel of the car door, the car door contact closes. When all the elevator landing door by-pass jumper and locking contacts are closed and that the car door contact 23 is closed, the car can travel in the elevator shaft.

If one of the elevator landing doors 21 is unlocked, the corresponding locking contact is open. Consequently the elevator will not operate. However, a user may open the elevator landing door and fall down the elevator shaft if the car is not at that landing.

To eliminate this inconvenience, the invention proposes a safety system principally comprising a synthesis unit 4 for the surveying of the working order of the elevator landing doors, preferably installed in the equipment room 2, and elevator landing door surveillance units 10, installed in the elevator shaft 1 at each landing of the building next to the elevator landing doors 21. The surveillance units 10 are connected, on one hand, to the locking contacts 11 and by-pass jumpers 12 of the elevator landing door, so as to be able to discern the state without having to disconnect them from the control unit 5, and on the other hand, to the synthesis unit 4, for example via a network 15.

Moreover, the synthesis unit 4 is connected to the elevator control unit 5 and to sound 13 and light 14 alarm signal devices in the elevator shaft 1, to alert the users of the danger of opening or approaching the elevator landing doors. The synthesis unit 4 can also be connected to an alarm signal device 16 installed in the caretaker's premises, and preferably to a local analysis and transmission unit 6, for example fitted with a telephone transmitter 6*a* to transmit information on the state of the elevator to a remote maintenance system 17.

Figure 3:
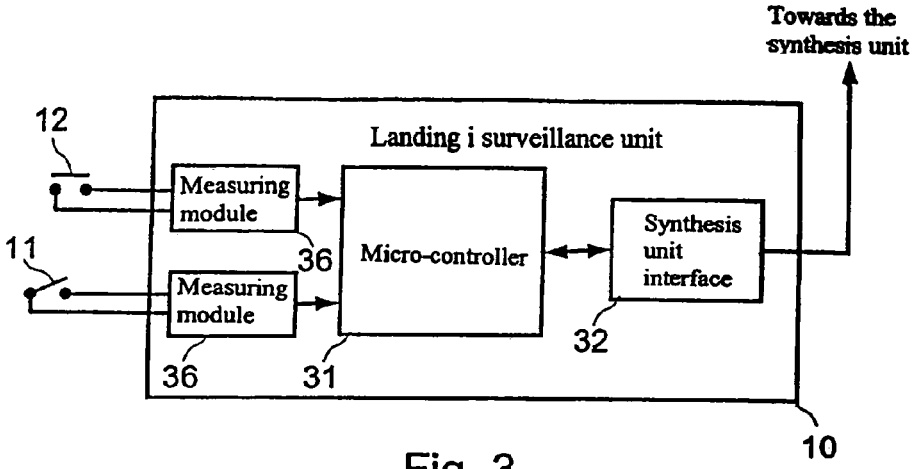
FIG. 3 shows in greater detail a landing surveillance unit represented in FIG. 1.

FIG. 3 shows in greater detail a surveillance unit 10. In this figure, the surveillance unit 10 comprises two measuring modules 36, for all tension or with dry contacts, respectively connected to the two elevator landing door contacts 11, 12 so as to receive the state, and a handling unit 31, for example of type micro-controller or microprocessor, connected on one side to the measuring modules 36 and, on the other, to a network interface circuit 32, connected to the network 15 of the surveillance units 10 and allowing communication with the synthesis unit 4.

Each surveillance unit 10 is preferably integrated into a strong and dustproof box.

Figure 4:
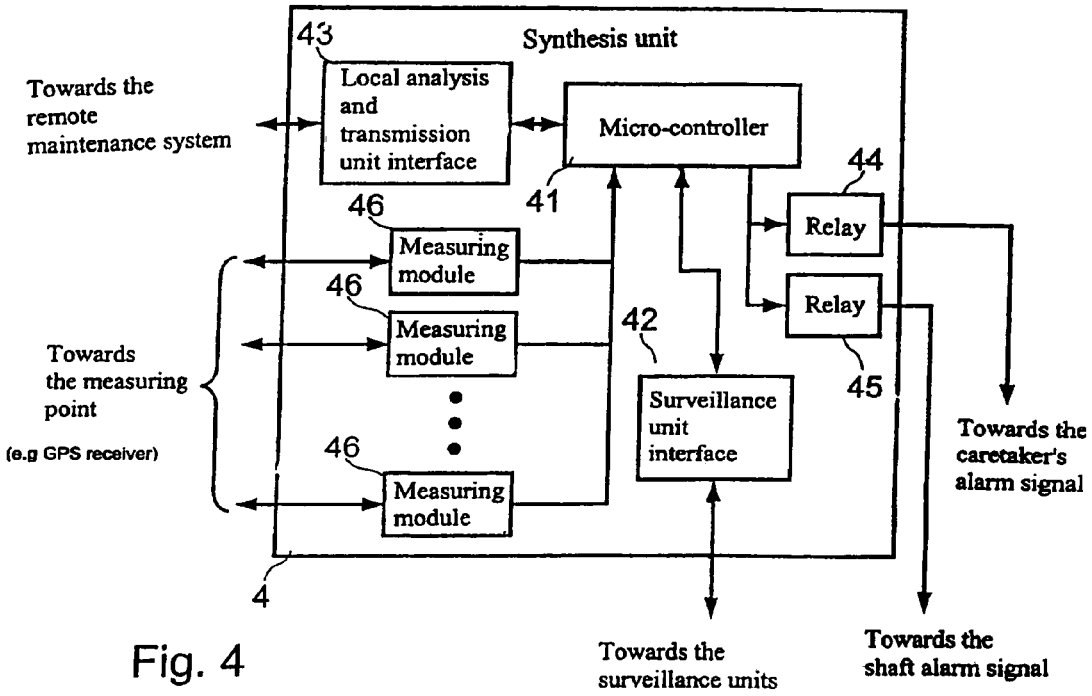
FIG. 4 shows in greater detail a synthesis unit represented in FIG. 1.

FIG. 4 shows in greater detail the synthesis unit 4. In this figure, the synthesis unit comprises a handling unit 41, such as a micro-controller or a microprocessor, an interface circuit 42 of connecting to the network 15 of the surveillance units 10, measuring modules 46 connected to a respective measuring point on the control unit 5, the relays 44, 45 allowing the alarm signal devices 13, 14 to be controlled, these being installed in the shaft 1, and possibly 16, in the caretaker's premises (technical or safety services).

The handling unit 41 of the synthesis unit 4 is programmed to constantly interrogate the surveillance units 10 so as to recuperate their replies and constantly test their working order, detect the critical states according to the information sent by the measuring modules 46 and by the surveillance units 10, actuate the control relays 44, 46 of the alarm signal devices 13, 14 during the detection of a critical state, and possibly, communicate with a local data analysis and transmission unit 6.

The interconnection network 15 between the surveillance units 10 and the synthesis unit 4 is preferably an industrial type network, resilient to radio-electric noise (for example RS485).

The synthesis unit 4 also comprises a power supply preferably backed up to ensure it operates as well as the surveillance units 10 in the event of a power cut. It is integrated into the box with a key lock to restrict access to authorised personnel only.

The synthesis unit 4 can also comprise an interface circuit 43 with a local data analysis and transmission unit 6.

In this way, the synthesis unit 4 comprises three operating modes:

- an autonomous mode in which the synthesis unit 4 detects abnormal openings of elevator landing doors 21 and actuate the alarm signal devices 13, 14 in the elevator shaft 1,
- a local mode in which the synthesis unit 4, along with the actions of the local mode, can actuate an alarm signal at the caretaker's premises, and
- a connected mode in which the synthesis unit 4 is additionally linked to a remote monitoring system 17, for example via a local analysis and transmission unit 6 fitted with a telephone transmitter 6*a* PSTN (Public Switched Telephone Network), possibly equipped with a GSM (Global System for Mobile Communications) transmitter 6*b*, and signals the alarms and operating errors to those responsible for the building management and elevator maintenance.

One of the measuring modules 46 of the synthesis unit 4 has been designed to recuperate information on the position of the elevator car in the shaft 1.

If this information is directly available from the elevator control unit 5, the measuring module 46 is connected to the control unit so as to receive this information in real time.

If the control unit does not provide the information on the position of the car in the shaft 1, this information is determined via an autonomous means linked to a measuring module 46. This means of autonomous measuring comprises for example a GPS receiver, an inertial unit or an accelerometer system installed in the car, or even an optical, laser or ultrasound range-finder placed in the shaft 1 and which constantly measures the distance between a fixed point and the car. This positioning information can also be determined by measuring the unreeling of the traction rope of the car, for example via a castor placed on the cable and linked to a sensor which determines the length of cable that has passed through the castor. This information can also be determined from the overspeed sensing cable (parachute).

Information on the position of the car 20 in the elevator shaft 1 can also be deducted from other information provided by the elevator control unit 5. In this case, several measuring modules 46 are necessary to recuperate information that indicates if the elevator car is ascending, information that indicates if the elevator car is descending, and information that indicates if the car is or is not at a pre-set position, which is generally the ground floor. Additionally, the synthesis unit 4 stores the elevator operating parameters onto memory, in particular, the number of landings, the ascending or descending time between each landing, and the pre-set landing position. These informations are manually imputed into the synthesis unit 4, or determined by the latter during a learning phase. The synthesis unit 4 further comprising means for determining, according to these informations, if the car is travelling between landing X and X+1 and if it is descending or ascending, or if the car has stopped in an elevator landing door unlocking zone and at which landing.

The synthesis unit 4 comprises two other measuring modules 46 connected to the control unit 5, one being connected to receive the closing contact information of the elevator landing door 24 and of the car 20, and the other being connected to receive information on whether the car is in the elevator landing door unlocking zone or not.

The handling unit 41 of the synthesis unit 4 is programmed to determine the state of an elevator according to the position of the elevator in the shaft, the state of the closing contact of the car door, information on whether the car is in the elevator landing door unlocking zone or not, and the state of the locking contacts 11 and by-pass jumpers 12 of the elevator landing doors 21, received by surveillance units 10.

The state of the elevator, thus determined by the handling unit 41, can take the following values: normal, broken-down (possible risk of a user being trapped), abnormal (a measuring point could be faulty), and critical (risk of falling down the elevator shaft).

When the state of the elevator is critical, the handling unit actuates the alarm signal devices 13, 14, 16 in the elevator shaft 1, and possibly at the caretaker's premises. Additionally, for abnormal, broken-down and critical elevator states, the state of the elevator is transmitted to the remote monitoring centre (if such a link has been provided for), preferably with an information on the value of the corresponding state informations.

There are three elevator operating categories. In the first category, the elevator car is at landing X and no other elevator landing door than that of landing X is unlocked. In this category, there is no risk of falling as only the elevator landing door susceptible to be open is that of the landing where the car has stopped.

In the second elevator operating category, the car is at a landing, but the elevator landing door of another landing is either unlocked or open. In this category, certain states are critical as there is a risk of a user falling down the elevator shaft.

In the third elevator operating category, the car is travelling in the elevator shaft. In this category, certain states are also critical when one of the elevator landing doors is unlocked.

All of the possible elevator operating states are given in the following table:

TABLE 1

| Case | Car position | Car door contact | Landing X locking contact | Landing x by-pass jumper | Other landings locking contacts | Other landings by-pass jumpers | State |
|---|---|---|---|---|---|---|---|
| 1 | Landing X | Open | Open | Closed | Closed | Closed | Normal |
| 2 | Landing X | Open | Open | Open | Closed | Closed | Normal |
| 3 | Landing X | Open | Closed | Closed | Closed | Closed | Broken-down |
| 4 | Landing X | Closed | Closed | Closed | Closed | Closed | Broken-down |
| 5 | Landing X | Closed | Closed | Open | Closed | Closed | Broken-down |
| 6 | Landing X | Open | Closed | Open | Closed | Closed | Abnormal |
| 7 | Landing X | Closed | Open | | Closed | Closed | Abnormal |
| 8 | Landing X | | | | Open | | Critical |
| 9 | Landing X | | | | Closed | Open | Broken-down |
| 10 | between landings | Closed | Closed | Closed | Closed | Closed | Normal |
| 11 | between landings | | Open | | | | Critical |
| 12 | between landings | | Closed | Open | Closed | Closed | Broken-down |
| 13 | between landings | Open | Closed | Closed | Closed | Closed | Broken-down |

An empty case in the table signifies that the corresponding contact state is indifferent.

Cases 1 to 7 belong to the first category. In cases 1 and 2, the state of the elevator is normal, the elevator landing door 21 where the elevator car 20 has stopped is unlocked and either open or closed.

In cases 3 to 5, the elevator is considered to be broken-down as entry to or exist from the car 20 is impossible, the elevator landing door remaining locked. Additionally, in case 5, the elevator landing door by-pass jumper 12 is open (prolonged traction of a user in the elevator landing door, clearance in the elevator landing door or badly set or faulty by-pass jumper).

In cases 6 and 7, the state of the elevator is abnormal as there is a discrepancy between the position of the car door 24, the elevator landing door by-pass jumper 12 and the elevator landing door locking contact 11.

Cases 8 and 9 belong to the second operating category. In case 8, the elevator landing door locking contact, other than where the elevator has stopped, is open. This state is critical as there is a risk of falling. In case 9, the elevator is considered to be broken-down as the by-pass jumper of another elevator landing door is open whilst the locking contact of the latter is closed.

The third category encompasses cases 10 to 13. In these states, the elevator car is travelling. In case 10, all the contacts are closed, hence the elevator is in a normal state. In case 11, an elevator landing door locking contact is open. There is therefore a risk of falling. Consequently the elevator is in a critical state.

In cases 12 and 13, the elevator is broken-down as there is a discrepancy between the closed state of the elevator landing door locking contact of a given landing and the state of the car door locking contact or the state of the elevator landing door by-pass jumper.

In an alternative implementation of the invention the positioning information of the car in the shaft is not available. In this case, the synthesis unit 4 only has, over and above the information provided by the surveillance units 10, information on the elevator car door contact and whether the car is or is not in the elevator landing door unlocking zone.

In this alternative implementation of the invention, the possible elevator operating states are as follows:

TABLE 2

| Case | Car position | Car door contact | Landing X locking contact | Landing x by-pass jumper | Other landings locking contacts | Other landings by-pass jumpers | State |
|---|---|---|---|---|---|---|---|
| 1 | In line | Open | Open | Closed | Closed | Closed | Normal |
| 2 | In line | Open | Open | Open | Closed | Closed | Normal |
| 3 | In line | Open | Closed | Closed | Closed | Closed | Broken-down |
| 4 | In line | Closed | Closed | Closed | Closed | Closed | Broken-down |
| 5 | In line | Closed | Closed | Open | Closed | Closed | Broken-down |
| 6 | In line | Open | Closed | Open | Closed | Closed | Abnormal |
| 7 | In line | Closed | Open | | Closed | Closed | Abnormal |
| 8 | In line | | Open | | Open | | Critical |
| 9 | In line | | Open | | Closed | Open | Broken-down |
| 10 | between landings | Closed | Closed | Closed | Closed | Closed | Normal |
| 11 | between landings | | Open | | | | Critical |
| 12 | between landings | | Closed | Open | Closed | Closed | Broken-down |
| 13 | between landings | Open | Closed | closed | Closed | Closed | Broken-down |

In cases 1 to 9, the elevator car has stopped at a landing. In all the other cases the elevator is not in an unlocking zone.

In cases 1 to 7, where the elevator car is at a landing in front of an elevator landing door, it is supposed that if a car is in line with an elevator landing door and that a locking contact 11 is in an open state, then this contact is on the same elevator landing door as the car. This also applies to the by-pass jumper 12.

In case 8, the elevator is in a critical state as two locking contacts are in an open state. In case 9, the elevator is considered to be broken-down as there is only one unlocking contact in an open state and the by-pass jumper of another elevator landing door is in an open state and therefore faulty.

In case 10, all the contacts are closed. The elevator positioned between two landings is in a normal state.

In case 11, the car 20 is positioned between two landings and an elevator landing door locking contact 11 is open. The elevator is therefore in a critical state as the corresponding elevator landing door could open even though the car may not have stopped at this landing.

In case 12, all the elevator landing door contacts are closed except at least one by-pass jumper 12. This contact is therefor faulty and the elevator is considered to be broken-down.

In case 13, the car door contact is in an open state whilst the car is positioned between two landings. The elevator is therefore also considered to be broken-down.

The invention claimed is:

1. Safety system for the elevator landing doors of an elevator fitted with an elevator control unit (5), and at each elevator landing door (21), electrical contacts (11, 12) that indicate the locking state and the closing state of the elevator landing door, characterised in that it comprises:

alarm signal devices (13, 14), elevator landing door surveillance units (10), installed on each elevator landing door (12), each surveillance unit (10) comprising measuring modules (36) respectively connected to the electrical contacts (11, 12) so as to receive the locking state and the closing state of the elevator landing door (21), the measuring modules (36) being connected to a processing unit (31) of the surveillance unit (10), and synthesis unit (4) connected to the surveillance units (10) to receive the state of the elevator landing door electrical contacts (11, 12), and connected to the elevator control unit (5) to receive other information on the working order of the elevator, the synthesis unit (4) comprising means of determining (41) an operating state of the elevator based on the information received from the surveillance units (10) and the elevator control unit (5), the operating state being one of a plurality of predetermined operating states, and to actuate the signal devices (13, 14) if the operating state of the elevator is determined to be critical to users of the elevator.

2. Safety system according to claim 1, characterised in that it comprises means of determining (22, 22') if an elevator car (20) is in the elevator landing door (21) unlocking zone and means of determining if the car (20) door (24) is closed or not, the operating state of the elevator also being determined according to whether the car (20) is or is not in the elevator landing door (21) unlocking zone and the open or closed state of the car (20) door (24).

3. Safety system according to claim 1, characterised in that it further comprises means of determining the position of an elevator car (20) in the elevator shaft (1), these means being connected to a synthesis unit (4), the operating state of the elevator also being determined according to the position, provided by the means of determining the position of the car.

4. Safety system according to claim 3 characterised in that the means of determining the position of the car (20) in the elevator shaft (1) comprises a GPS receiver installed on the car or a device that measures the distance between a fixed point and the car.

5. Safety system according to claim 3 characterised in that the means of determining the position of the car (20) in the elevator shaft (1) comprises means of deducing this information from data provided by the elevator control unit (5), and from configuration and operating parameters of the elevator.

6. Safety system according to claim 1, characterised in that it comprises means of determines (41) that the operating state of the elevator is critical if an elevator car (20) has stopped at a landing in line with an elevator landing door, and if another elevator landing door has been detected as being unlocked, or if the car has been detected between two landings and at least one elevator landing door has been detected as being unlocked.

7. Safety system according to claim 1, characterised in that the alarm signal devices comprise means of sound and/or light signalling installed in the elevator shaft (1).

8. Safety system according to claim 1, characterised in that the alarm signal devices comprise means of alarm signalling (16) installed in the caretaker's premises.

9. Safety system according to claim 1, characterised in that the synthesis unit (4) is linked to means of transmitting the operating state of the elevator to a remote maintenance system.

10. Safety system according to claim 9 characterised in that the means of transmitting comprise a telephone transmitter.

11. Safety system according to claim 9, characterised in that the means of transmitting comprise a PSTN type telephone transmitter backed up by a GSM type transmitter.

12. Safety system according to claim 1, characterised in that the plurality of predetermined operating states comprises at least two of the following: a critical state, a broken-down state, an abnormal state, and a normal state.

* * * * *